United States Patent [19]

Brown

[11] Patent Number: 5,070,520

[45] Date of Patent: Dec. 3, 1991

[54] X-RAY MACHINE ASSEMBLY INCLUDING TABLE COVER AND METHOD

[76] Inventor: Timothy E. Brown, 107 E. McKinley, Tempe, Ariz. 85281

[21] Appl. No.: 641,781

[22] Filed: Jan. 16, 1991

Related U.S. Application Data

[63] Continuation-in-part of Ser. No. 539,562, May 18, 1990, Pat. No. 4,991,242.

[51] Int. Cl.[5] ..... H05G 1/02; A47G 9/00

[52] U.S. Cl. ..... 378/196; 378/209; 5/484; 5/497; 5/495

[58] Field of Search ..... 378/196, 195, 208, 209; 5/455, 484, 496, 495, 497, 60

[56] References Cited

U.S. PATENT DOCUMENTS

| | | | |
|---|---|---|---|
| 2,803,836 | 8/1957 | Hunsicker | 5/484 |
| 3,889,302 | 6/1975 | Ketterer et al. | 5/484 |
| 4,680,821 | 7/1987 | Maguire | 5/496 |
| 4,910,819 | 3/1990 | Brown | 5/484 |
| 4,991,242 | 2/1991 | Brown | 5/60 |
| 4,993,092 | 2/1991 | Weeks | 5/484 |

*Primary Examiner*—Janice A. Howell
*Assistant Examiner*—Kim-Kwok Chu
*Attorney, Agent, or Firm*—Harry M. Weiss

[57] ABSTRACT

A medical machine assembly such as an X-ray machine assembly is disclosed which has a cover for conducting patient body fluids and other spilled fluids away from contact with any part of the machine assembly and especially form the interior thereof. This assembly includes a base, an x-ray tube, a patient table mounted on the base, a cushion disposed on the patient table, and a cover disposed on the cushion. The cushion has a body portion and a rear dam portion. The cover has a rear dam portion located on the cushion dam portion. The cover also has a middle body portion disposed on the cushion body portion. The cover also has a front flap portion for conducting patient body fluids and other spilled fluids outwardly from the middle body portion and away from contact with any part of the machine assembly.

12 Claims, 1 Drawing Sheet

X-RAY MACHINE ASSEMBLY INCLUDING TABLE COVER AND METHOD

This is a continuation-in-part of my copending U.S. Pat. application entitled "Patient Table cover and Method" Ser. No. 07/539,562; filed Jun. 18, 1990, now U.S. Pat. No. 4,991,242.

FIELD OF THE INVENTION

This invention generally relates to a medical machine assembly including table cover and method, and, in particular, this invention relates to an x-ray machine assembly including table cover and method wherein the cover has a rear dam portion and a front flap portion.

BACKGROUND OF THE INVENTION

The prior art x-ray machine assembly generally included a base, an x-ray tube assembly, a patient table cooperatively positioned with respect to the x-ray tube assembly having a cushion, and a cover thereon.

A major problem that was associated with the prior art x-ray machine assembly is that very often patient body fluids or other fluids supplied to the patient flowed from the patient onto the table and through a spacing between the cover and the edge of the table thereby entering into the interior of the base, which houses electrical and electromechanical motor and control components. This caused a necessary periodic cleaning of the interior of the base and components which required a complete shutdown of the machine thereby reducing machine utilization. Also, body fluid residue was usually left even after careful cleaning which tended to accumulate thereby causing an unsanitary condition.

A related prior art patent is my U.S. Pat. No. 4,910,819, which issued Mar. 27, 1990. This patent describes a CT-scanner having a baseplate, a cushion, and a cover. However, the cover of my prior U.S. Pat. No. 4,910,819 did not have the specific features of the cover of this invention to overcome the above described problems of the spilling of fluids into the interior of the base.

In my copending U.S patent application Ser. No. 07/539,562, entitled "Patient Table Cover And Method", filed 6/18/90 I have disclosed a patient table assembly having a base, a patient table, a cushion, and a cover with opposite side flap portions. However, the cover of my copending U.S. Pat. No. Application also did not have the specific features of the cover of this invention to overcome the above described problem of the spilling of fluids into the interior of the base.

SUMMARY OF THE INVENTION

Accordingly, it is an object of this invention to provide an improved medical machine assembly including table cover and method.

It is another object of this invention to provide an improved X-ray machine assembly including table cover and method.

It is further object of this invention to provide an improved X-ray table cover and method which avoids the spilling of fluids into the interior of the base of an X-ray machine assembly.

BRIEF DESCRIPTION OF THIS INVENTION

According to the present invention a medical machine assembly is provided. This assembly includes a base, an x-ray tube assembly, a patient table, a cushion supported by the patient table, and a cover supported by the cushion wherein the cover has a rear dam portion and a front flap portion means extending over an edge of the patient table for protecting against fluids flowing around the cushion and the patient table into an interior portion of the base.

By using the cover having a rear dam portion and a front flap portion means, the flow of patient body fluids or other fluids onto the table and into the interior of the base is avoided and machine shutdown frequency is greatly minimized.

The foregoing and other objects, features and advantages will be apparent from the following description of the preferred embodiment of the invention as illustrated in the accompanying drawings.

DESCRIPTION OF THE PREFERRED EMBODIMENT

Figure 1:
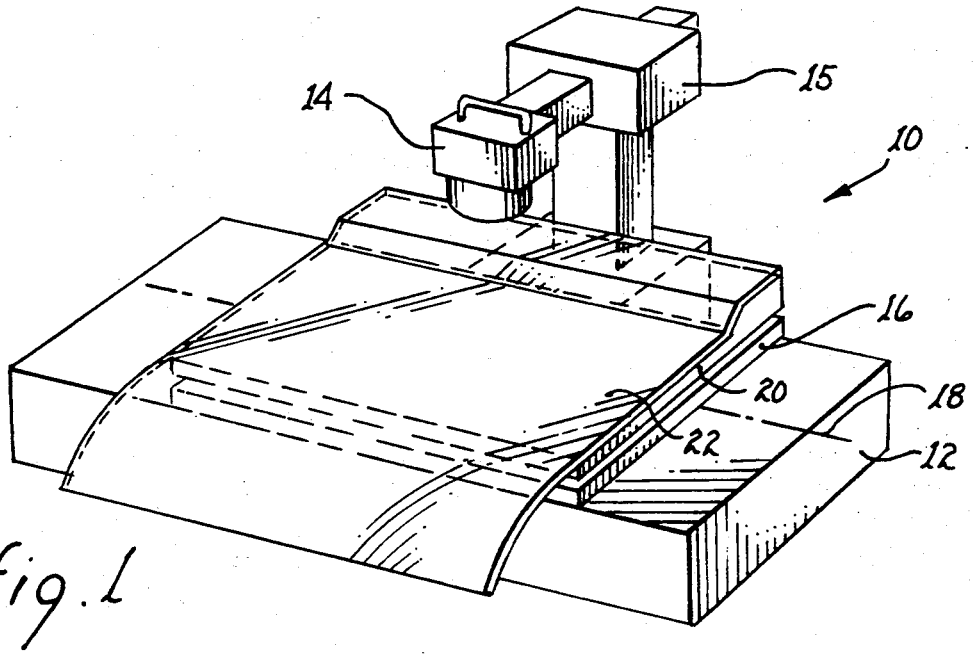
FIG. 1 is a perspective view of an x-ray machine assembly according to the invention.

As shown in FIG. 1, an x-ray machine assembly 10 is provided. Assembly 10 has a base 12, an x-ray tube assembly 14 which has a support 15 that is mounted on base 12, and a patient table 16. Patient table 16 is supported by base 12, and is intended to support a patient and is moveable, for example, along an axis 18. Assembly 10 also has a cushion 20, which is supported by table 16, and has a cover 22, which is supported by cushion 20. Cushion 20 has a sufficient length and width to cover table 16.

Figure 2:
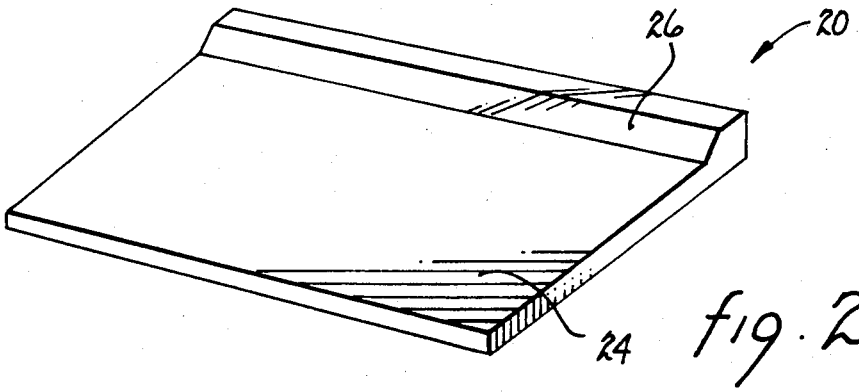
FIG. 2 is a perspective view of the cushion used in the X—ray machine assembly of FIG. 1.

As shown in FIG. 2, cushion 20 has a body portion 24, and has a rear lip or dam portion 26. Dam portion 26, in this embodiment, is preferably about 2 inches to 4 inches in height and 2 inches to 4 inches in depth. Dam portion 26 prevents a rearward flow of fluids onto base 12 and into the interior thereof.

Figure 3:
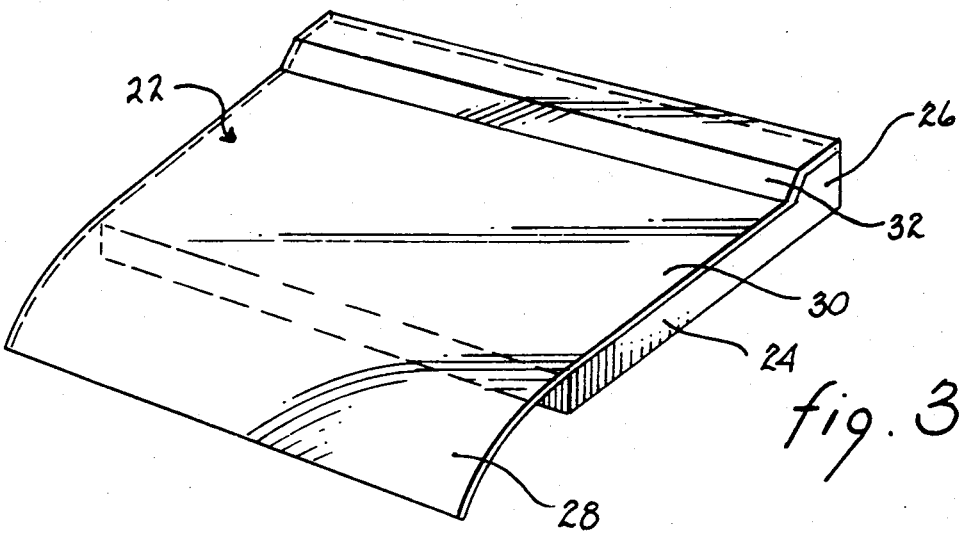
FIG. 3 is a perspective view of the cover located on the cushion that are used in the X-ray machine assembly of FIG. 1.

As shown in FIG. 3, cover 22 has a front flap portion 28, and has a middle body portion 30, which covers cushion body portion 24, and has a rear shaped dam portion 32, which covers cushion dam portion 26.

Flap portion 28 causes patient body fluids and other spilled fluids, and the like, to flow away from and off the patient table 16, and not around the cushion 20 onto patient table 16 and then into the interior of base 12 where the components are located. Flap portion 28 preferably contains cover type material plus a relatively large amount of lead material, or lead fibers, or other x-ray absorbing material, whereby radiation exposure of the machine operator, such as a physician or medical technician, from any source of radiation generated from within the base 12 is minimized. The operator normally stands alongside the table front side adjacent to the protective flap portion 28 of the cover 22.

The advantage of assembly 10 is that flap portion 28 of cover 22 avoids fluid flow into the interior of base 12 and onto components housed in base 12, whereby shutdown frequency for cleaning is minimized. In addition, cushion dam portion 26 and its correspondingly shaped cover dam portion 32 substantially eliminate any fluid flow over table 16 at the rear side thereof. Also, any build-up of an unsanitary condition in the interior of base 12 is avoided.

While the invention has been described in its preferred embodiment, it is to be understood that the words which have been used are words of description rather than limitation and that changes may be made within the purview of the appended claims without departing from the true scope and spirit of the invention in its broader aspects. For example, a left end dam portion and a right end dam portion, which would be similar in construction to the rear dam portion, composed of cushion dam portion 26 and cover dam portion 32, may be added to assembly 10 thereby providing three dam portions on three sides and flap portion 28 on the fourth side. Also, while the invention is described with reference to X-ray type machine assemblies, other medical table assemblies can be utilized in accordance with this invention wherein other equipment can be used (other than X-ray table assembly equipment) in combination with a base, a patient table, cushion and cover.

The embodiments of an invention in which an exclusive property or right is claimed are defined as follows:

1. A medical machine assembly comprising:

a base;

a patient table located on the base;

a cushion which is supported by the patient table;

a cover which is supported by the cushion;

said cushion having a rear dam portion and a body portion;

said cover having a rear dam portion which is located on the cushion rear dam portion;

said cover having a middle body portion disposed on the cushion body portion;

said cover having front flap portion means extending outwardly from the cover middle body portion over an edge of the patient table for protecting against fluids flowing around said cushion and said patient table into an interior portion of said base.

2. The assembly of claim 1 wherein the flap portion means comprises lead material.

3. The assembly of claim 1 wherein the flap portion means comprises a radiation absorbing material.

4. The assembly of claim 1 wherein an X-ray tube assembly is coupled to said base.

5. A method of protecting against undesired spilling of fluids into the interior of a medical machine assembly having a base and a patient table located on the base comprising the steps of:

forming a cushion having a rear dam portion for preventing rearward flow of patient body and other fluids and having a body portion attached to the rear dam portion for placement on the patient table; and forming a cover having a rear dam portion located on the cushion's rear dam portion and having a middle body portion disposed on the cushion's body portion and having a front flap portion extending outwardly away from the middle body portion and over an edge of said cushion and said patient table for passage of patient body fluids and other spilled fluids away from any part of the medical machine assembly.

6. The method of claim 5 including the step of providing an X-ray tube assembly coupled to said base.

7. The method of claim 5 including the steps of forming a left dam portion and a right dam portion on said cushion; and forming said cover with correspondingly shaped left and right dam portions in contact with said left and right dam portions of said cushion.

8. The method of claim 5 wherein the flap portion comprises radiation absorbing material.

9. The method of claim 8 wherein the flap portion comprises lead material.

10. A covered cushion for a medical machine assembly having a base and a patient table comprising, in combination:

a cushion having a body portion for placement on the patient table and having a rear dam portion; and a cover having a middle body portion disposed on the cushion body portion and having a rear dam portion located on the cushion rear dam portion and having front flap portion means extending outwardly away from the middle body portion for conducting patient body fluids and other spilled fluids away from the middle body portion and away from an edge of the patient table.

11. The covered cushion of claim 10 wherein said covered cushion is located on an X-ray machine assembly.

12. The covered cushion of claim 10 wherein said front flap portion comprising radiation absorbing material.

* * * * *